United States Patent [19]

Pejovic

[11] Patent Number: 4,592,607

[45] Date of Patent: Jun. 3, 1986

[54] ELECTRICAL CONNECTOR PLUG CONTROL

[76] Inventor: Radovan Pejovic, 5855 N. Sheridan Rd. - Apt. 12-K, Chicago, Ill. 60660

[21] Appl. No.: 697,248

[22] Filed: Feb. 1, 1985

[51] Int. Cl.[4] ..... H01R 13/44

[52] U.S. Cl. ..... 339/37; 339/44 R

[58] Field of Search ..... 339/36, 37, 44 R

[56] References Cited

U.S. PATENT DOCUMENTS 4,451,101 5/1984 Davis ..... 339/37

4,488,764 12/1984 Pfenning et al. ..... 339/37

FOREIGN PATENT DOCUMENTS 1354173 1/1964 France ..... 339/37

*Primary Examiner*—Gil Weidenfeld

*Assistant Examiner*—Paula A. Austin

*Attorney, Agent, or Firm*—Paul H. Gallagher

[57] ABSTRACT

A casing made up of two parts hinged together and movable between open and closed position. The connector plug of an electrical cord is placed in the casing and the casing is locked, with the conductor of the cord extending out through a small opening, through which the plug cannot pass. The plug is thereby encased, and cannot be plugged into a socket.

1 Claim, 7 Drawing Figures

Fig. 1
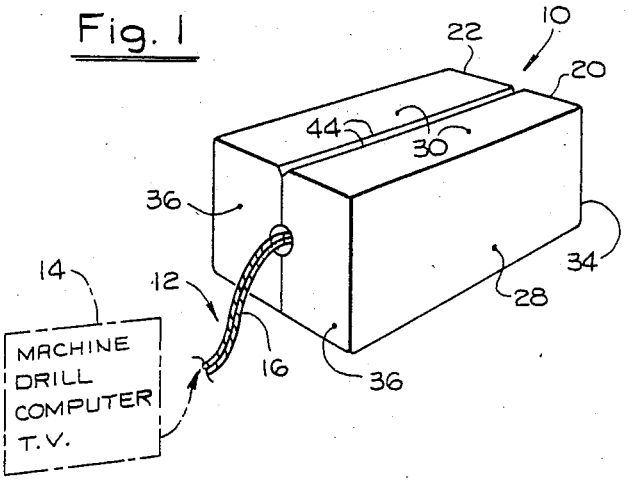
Fig. 2
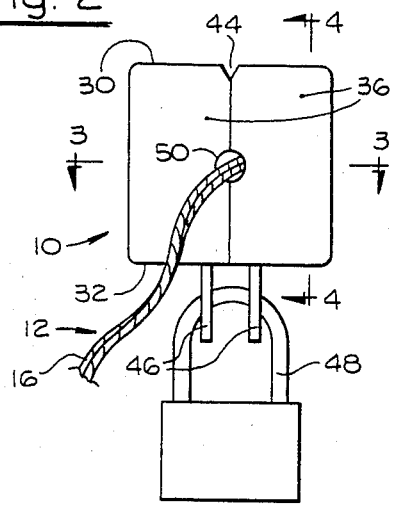
Fig. 3
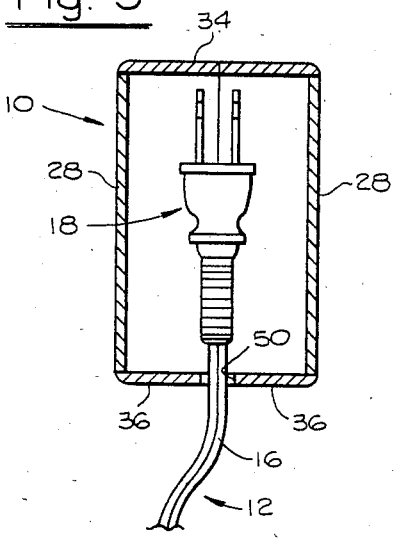
Fig. 4
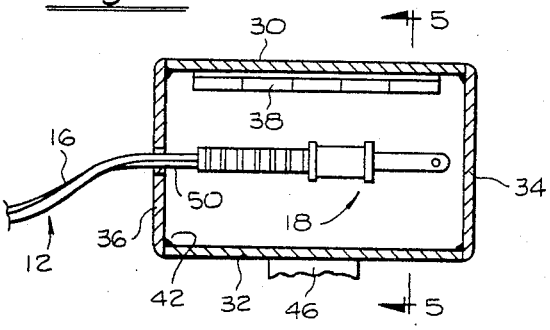
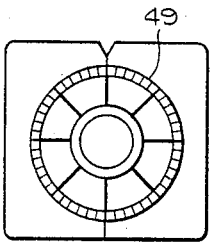
Fig. 6
Fig. 5
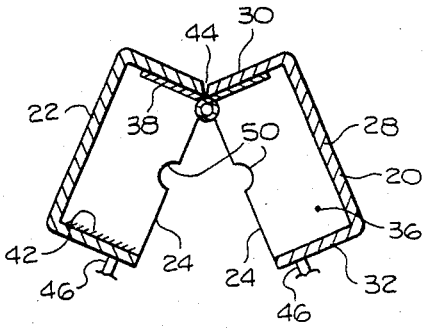
Fig. 7
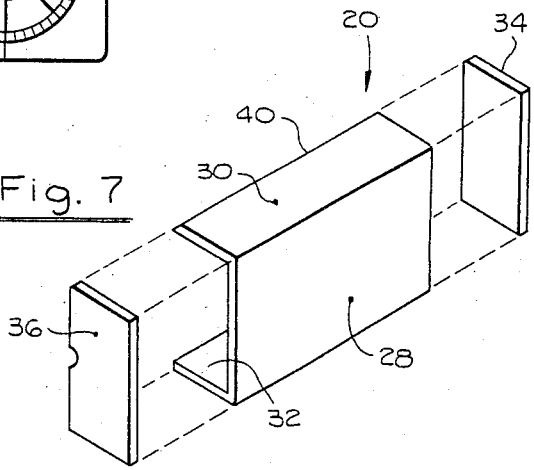

ELECTRICAL CONNECTOR PLUG CONTROL

FIELD OF THE INVENTION

The invention resides in the field of controlling the use of electrical appliances. Such control of appliances has been recognized as a difficult thing, and is of two principal forms, one of safety and the other of discipline.

One example, from the standpoint of safety, is the use of machines in a factory which are to be operated only by certain persons, or a drill or a saw in the home, which are not to be used by a child. Another example, from the standpoint of discipline, is TV, where it is undesireable to have turned on, because of objectionable programs, or total time spent in watching it.

OBJECTS OF THE INVENTION

A broad object of the invention is to provide means and method of controlling the use of electrical appliances, being particularly effective from the standpoint of both safety and discipline in such use.

A more specific object is to provide such means and method which renders the connector plug on the electrical cord of the appliance, incapable of being inserted in an electrical outlet, which thereby renders the appliance unusable, incorporating the following features and advantages:

1. The device completely encloses the connector plug, and it is locked, rendering it impossible to insert the plug into an electrical outlet.

2. The device is extremely simple both in the materials used in its manufacture, and in its fabrication, resulting in an inexpensive article accessible to virtually everyone.

3. It is extremely simple and easy to put in operative position and to remove it therefrom.

4. It is of strong construction and fool-proof against any unauthorized person attempting to remove it from its operating position.

5. It is of very pleasing appearance, and will blend in well in the appearance of surroundings, which is particularly advantageous in its use in the home.

DESCRIPTION OF A PREFERRED EMBODIMENT

In the drawings,

FIG. 1 is a perspective view of the device of the invention;

FIG. 2 is an end view of the device, taken from the left of FIG. 1 and showing lock means on the bottom which is not shown in FIG. 1;

FIG. 3 is a sectional view taken at line 3—3 of FIG. 2;

FIG. 4 is a sectional view taken at the line 4—4 of FIG. 2;

FIG. 5 is a sectional view at the position of line 5—5 of FIG. 4 but showing the device in open position;

FIG. 6 is an end view of a modified form of device, oriented according to FIG. 2; and FIG. 7 is an exploded perspective view of the pieces making up one-half of the shell of the device.

Referring in detail to the drawings, the device of the invention is indicated in its entirety at 10 and is used in connection with an electrical connector cord indicated in its entirety at 12, which is connected with an appliance indicated at 14. The appliance may be of any of various instrumentalities referred to again hereinbelow, and as used herein, appliance in generic to all such instrumentalities. The electrical connector cord 12 includes a conductor 16 on the end of which is a connector plug 18 for insertion into a connector socket. In this instance the device 10 is utilized for entirely enclosing the connector plug 18 to prevent its use in turning on the appliance 14.

The specific advantages of the device are referred to again hereinbelow, but attention is directed first to the specific mechanical construction of the device.

The device 10 is made up of two parts or halves 20, 22 which may be substantially identical in construction. Each part is in the shape of a shell having an open side or face 24, and otherwise being generally enclosed. Specifically each part includes an outer wall or back 28, top and bottom walls 30, 32, and end walls 34, 36.

The parts 20, 22 are interconnected by suitable means, such as hinge means 38 of known kind, having leaves secured to the corresponding top elements 30 of the parts, as by welding. Preferably the hinge means is placed on the inside so as not to disrupt the outer smooth surface of the finished device.

Each of the parts 20, 22, is of extremely simple construction, constituting an advantage of the invention. While these parts may be made in any various ways, a preferred construction is shown best in FIG. 7, and indicated in FIGS. 3 and 4. In keeping with the simplicity and economy in manufacture, each part 20, 22, includes a center section 40 that may be a piece or section of ordinary steel channel, having open ends and having a web constituting the back wall 28, and flanges constituting the top and bottom walls 30, 32. End pieces are secured to the open ends of the channel piece 40 which form the corresponding end walls 34, 36. They may be secured as by welding as indicated at 42, at appropriate locations, preferably on the inner surface. The inner edges of the top wall elements 30 are beveled or inclined at 44 to accommodate swinging of the parts to open position (FIG. 5). When the parts are moved to closed position, with their open sides interengaging, they form a casing or box or container.

Suitable locking means is provided for locking the parts in closed position. Such locking means may be any of various kinds, one form being shown in FIGS. 2 and 5 where loops 46 are secured to corresponding parts, 20, 22, in a suitable manner, such as by welding, and a lock 48 such as a padlock, is used for locking the parts in closed position.

FIG. 6 shows an alternate form of lock which may be a combination lock of known kind, secured to and between the parts of the device. The particular kind of lock used does not enter into the invention. In any case, whether in the use of the padlock 48 of FIG. 2, or the combination lock 49 of FIG. 7, or other kinds, the locking and unlocking is under the control of an authorized person, such as the owner, and the device cannot be opened by an unauthorized person.

As indicated above, and shown in the drawings, the parts or halves 20, 22 are moveable to open position of FIG. 5 and to closed position of FIGS. 1–4. The end wall elements 36 have recesses or notches 50 which open through the edges of those walls in the open faces 24 of the parts. In using the device, the parts are moved to open position, the connector plug 18 is put in one or the other of the parts, or generally in the space between them, with the conductor 16 in position between the recesses 50. Then the parts are moved to closed position, with the conductor in the recesses, and the plug confined within the casing. It will be understood that the plug is of substantially greater transverse dimensions than the conductor, and the recesses 50 are no larger than necessary to accommodate the conductor, and consequently the plug is confined against removal. Instead of having a recess 50 in each of the parts, a single such recess may be sufficient, for accommodating the conductor.

The uses to which the device can be put are numerous, and the results to be obtained are likewise numerous. A great concern involved in all present day activity is that of safety. Safety conditions are encountered in numerous situations, in industry, and in the home. In industry, for example, it is highly desired, and actually essential, that many machines or pieces of equipment be controlled with absolute assurance. Many machines can be safely operated only by the highly skilled, and those machines must not be operated by anyone else. Great measures are taken to prevent such machines from being turned on, and it is extremely difficult to accomplish that end. Specific examples of such machines are complicated machines that require great training for safely operating. Other considerations involve expensive machinery, which is not to be operated after hours, or without proper supervision. Other machines or devices may include drills or saws, etc. In the latter instance these devices are also encountered in the home, and these devices or appliances cannot safely be used by children, and should not be used by any non-skilled persons. The device is entirely safe and cannot injure anyone meddling with it.

Other instances of the control of apparatus include, for example, computers. The use of computers is based not only on safety, but discipline as well. Computers may cause disruption of electronic systems, both within an organization where the computer is incorporated, and other and unrelated electronic systems. Such disciplinary concern is also involved in the home. In the home, such discipline may include the control of computers, for example, and the use of the TV as well. The use of TV by children is an extremely important and involved segment of discipline; many programs are undesirable, and parents encounter many problems in so controlling the use of TV by children. Many programs are considered highly undesirable by parents, such as porno presentations, violence scenes, and others. It is difficult to guard the TV and visually watch the activities of the children, and many times the only effective way of controlling the TV is to render it unusable. The device of this invention produces that effect.

Another instance of the kind of control provided by the device is preventing the wasting of energy. An example is the use of an air conditioner—it may be desired to prevent the use of that device, or limit its use, while others would surreptitiously turn it on, but this device would prevent that, and prevent corresponding waste of energy.

Still further considerations include security. Various security components, including electronics instrumentalities, have connector plug-in cords for energizing them, and in such cases the present device is effective for preventing unauthorized use thereof. Portable telephones are another instance of where control is often desired and can be affected by this device.

In the broad interpretation of the invention, the device is usuable for rendering the connector plug unusable, by rendering it inaccessible, and it cannot be rendered accessible again except by an authorized person. This concept includes the condition that the device can be removed from its active or operating position easily and readily, without in any way adversely affecting the connector plug, or any other elements related thereto. The device can be applied to and removed from the plug repeatedly, without in any way adversely affecting the device itself, as well as the plug, and no unwanted effects are produced except as desired and intended by the use of the device. The incapability of use of the device is only temporary, and under the complete control of the authorized person.

Another great advantage of the device is its appearance and general esthetic effect. The device appears simply as a box, attached to the end of a cord. Upon completion of the fabrication of the box, it is smoothed and provided with any kind of finish desired, bright or dull, colored or plain, or having any of various colors and textures, which may fit in with the decor of the home, as well as other places. On this latter point the combination lock feature of FIG. 6 may be desired, since that lock appears more integrated or confined with the box itself, in contrast to a dangling padlock. Also it may be desired to provide a lock at any other place rather than those illustrated.

The device is extremely small and light in weight. The electrical cord to which it is applied can be dropped on the floor without being unsightly. When it is applied, the cord can be handled, such as by swinging, by grasping it at a position removed from the plug, and the device does not impede such movements.

The device is of extremely simple construction and therefore inexpensive, and is within the reach, from a price standpoint, of virtually everyone.

I claim:

1. A control device for controlling the use of a connector plug on an electrical cord, the plug being of substantially greater transverse dimensions than the cord, and in the use of which the plug is plugged into a connector counterpart, comprising, a casing made up of a pair of equal-sized parts connected together for movement between a closed position and an open position, the parts each being in the form of a shell having an open side and being otherwise generally closed, and each including a center section constituted by a channel piece having a web and flanges, and open ends, and end pieces secured to the channel piece and closing the open ends, the end pieces being welded to the channel piece and thereby forming a unitary and effectively integral said part, the parts when in open position enabling the placement of the plug into the space generally between the parts, and the parts being capable of being moved to closed position with the plug so placed, and when so moved to closed position, completely enclosing the plug, and at least one of the parts having a small recess in one of said end pieces at its open side which, when the parts are in closed position, forms an opening for receiving the cord but which prevents movement of the plug therethrough, the parts when in closed position having their open sides lying in a common plane and interfacing, and having outer surfaces extending generally in common direction across said common plane, the casing including hinge means secured to the inner surfaces of corresponding flanges of the channel pieces, the meeting edges of said corresponding flanges having beveled surfaces accommodating movement of the parts to open the device including means for releasably locking the parts in closed position, whereby to prevent the use of the plug for connection with a connector counterpart.

* * * * *